US005244107A

United States Patent [19]

Battegazzore

[11] Patent Number: 5,244,107

[45] Date of Patent: Sep. 14, 1993

[54] TAMPER-PROOF CLOSURE FOR BOTTLES AND THE LIKE

[75] Inventor: Piero Battegazzore, Alessandria, Italy

[73] Assignee: Guala S.P.A., Alessandria, Italy

[21] Appl. No.: 885,752

[22] Filed: May 18, 1992

[30] Foreign Application Priority Data

Apr. 29, 1992 [IT] Italy ..... 001163 A/91

[51] Int. Cl.[5] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 2,423,582 | 7/1947 | Coleman | 215/252 |
| 4,278,180 | 7/1981 | Willis | 215/252 |
| 4,305,516 | 12/1981 | Perne et al. | 215/252 |
| 4,796,770 | 1/1989 | Begley | 215/252 |
| 5,040,692 | 8/1991 | Julian | 215/252 |

*Primary Examiner*—Stephen P. Garbe
*Assistant Examiner*—Nova Stucker

[57] ABSTRACT

A tamper-proof closure for a bottle and the like, which comprises a cap adapted for screwing on/off the bottle, a sealing band connected to the cap by bridge portions, and abutments formed on the band to engage respective teeth formed on the bottle, has the advantage of an improved indication of the closure having been unsealed, by virtue of the band being split in at least two arched sections which are provided, at the leading and trailing ends in the screw-off direction of the cap, with respective bridge portions of connection to the cap and respective abutments, the bridge portion located at leading end being ruptured upon engagement of the respective abutment with the respective tooth, and the bridge portion located at the trailing end constituting a hinge for shifting the arched section angularly following engagement of the respective abutment with the respective tooth.

4 Claims, 3 Drawing Sheets

TAMPER-PROOF CLOSURE FOR BOTTLES AND THE LIKE

This invention relates to a temper-proof closure for a bottle and the like, as defined in the preamble of claim 1.

It is a recognized fact that such closures, while being satisfactory on the whole and widely employed, still have a drawback in that they provide inadequate indication of having been unsealed and that, when first unsealed, they perform in a less than positive, random, and ultimately inconsistent fashion.

If the sealing band, once separated from the cap, stays with the bottle, then it becomes easy, by application of ordinary skill, to set it back against the cap directly as the latter is screwed down again to disguise the unsealed condition. Further, the band interferes with the normal use of the bottle, and after consumption, may require to be removed for re-use of the bottle.

Occasionally, the band may slip off the bottle in pouring, creating an objectionable situation.

The underlying problem of this invention is to provide a closure as indicated, which has such constructional and performance characteristics as to overcome the aforesaid drawbacks.

This problem is solved by a closure of the kind specified hereinabove being as set forth in the characterizing part of claim 1.

Figure 1:
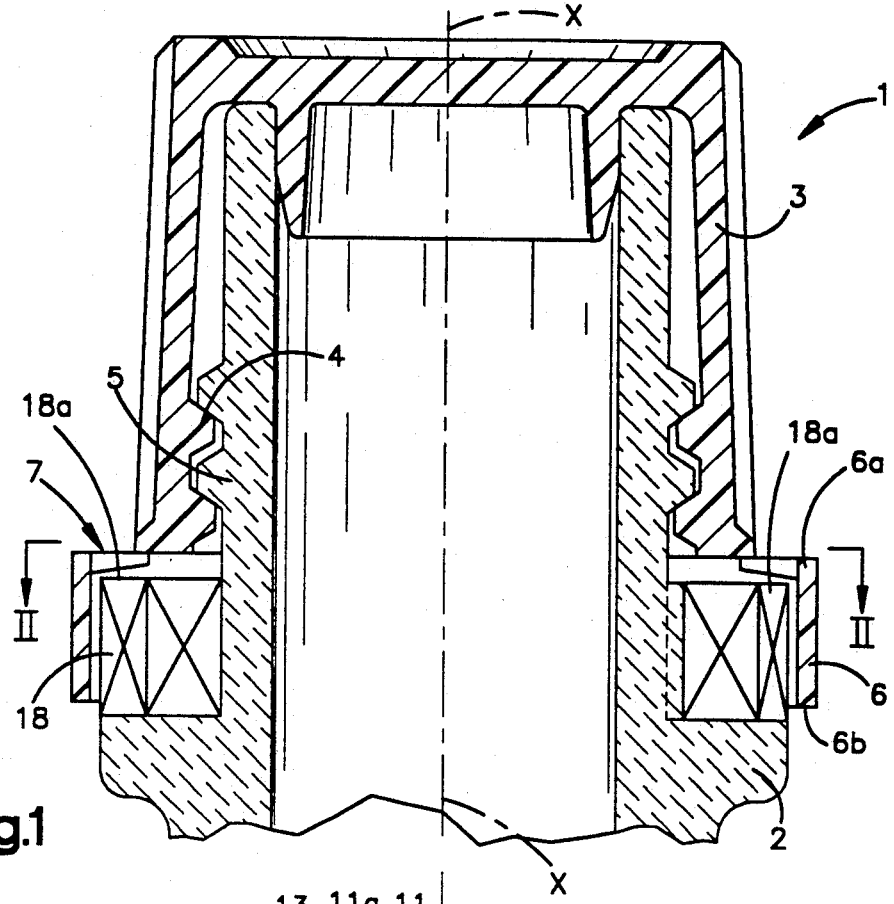
Figure 2:
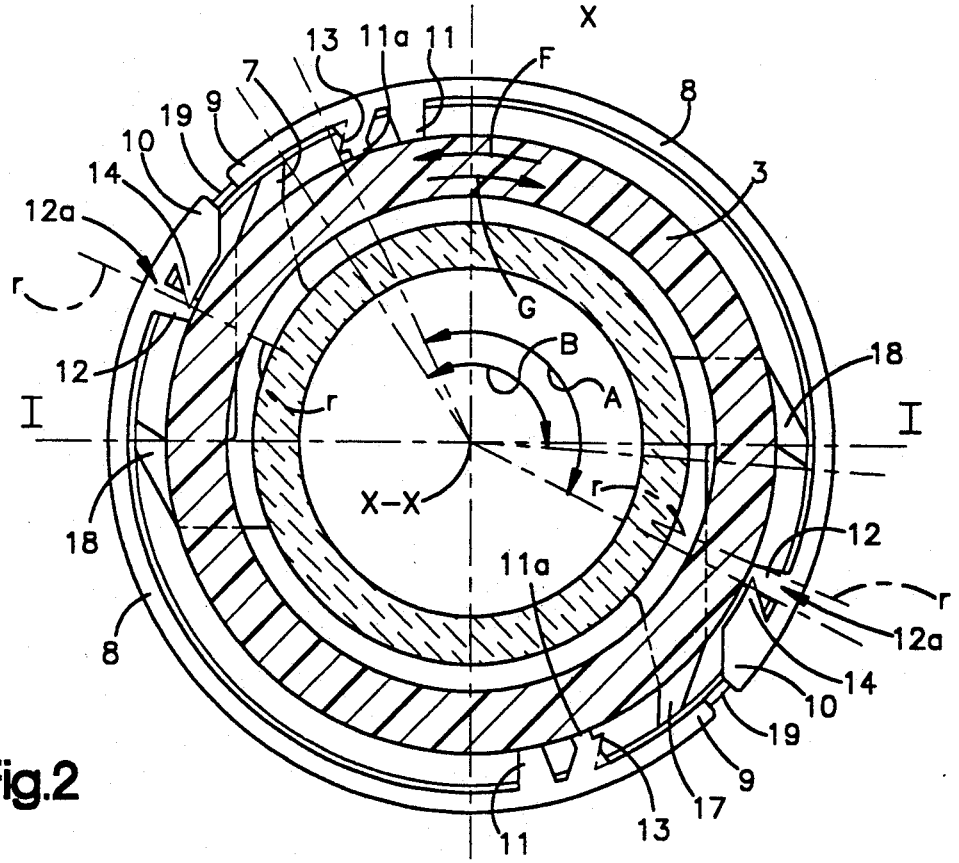
Figure 3:
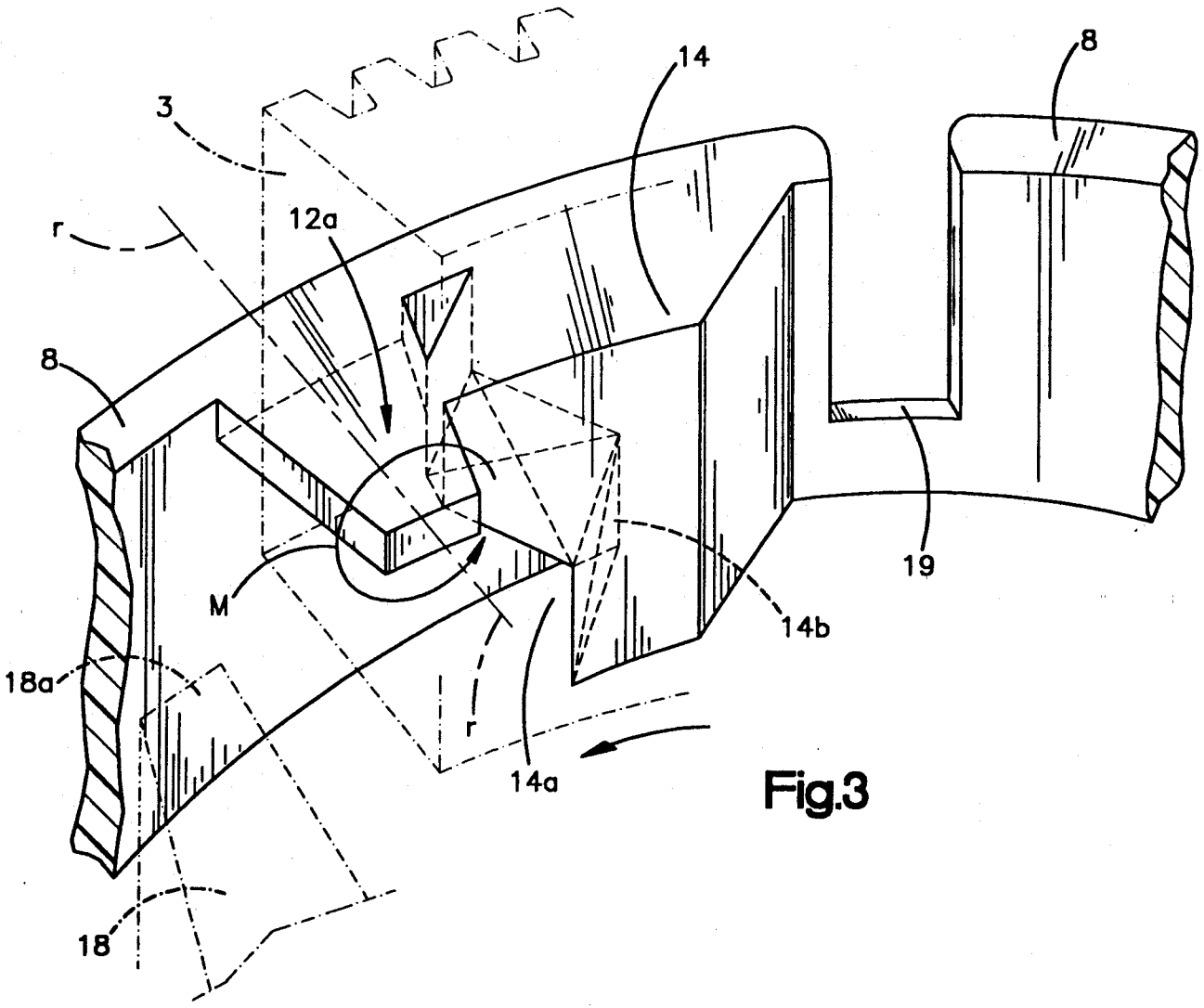
Figure 4:
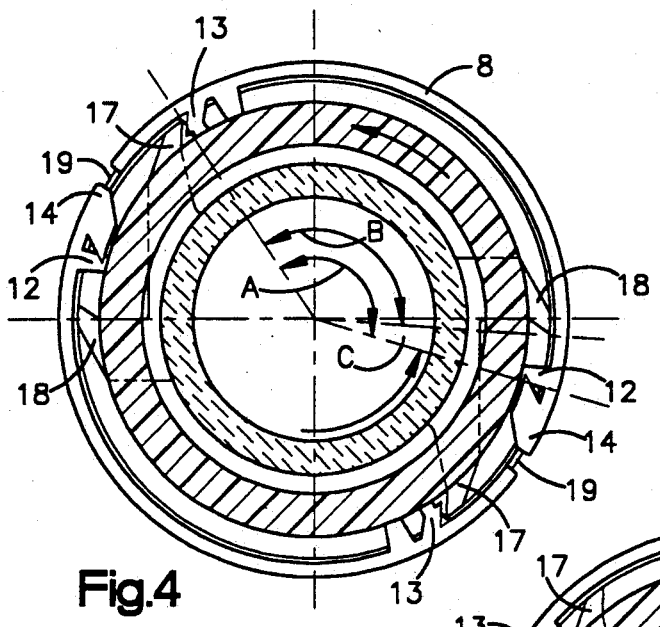
Figure 5:
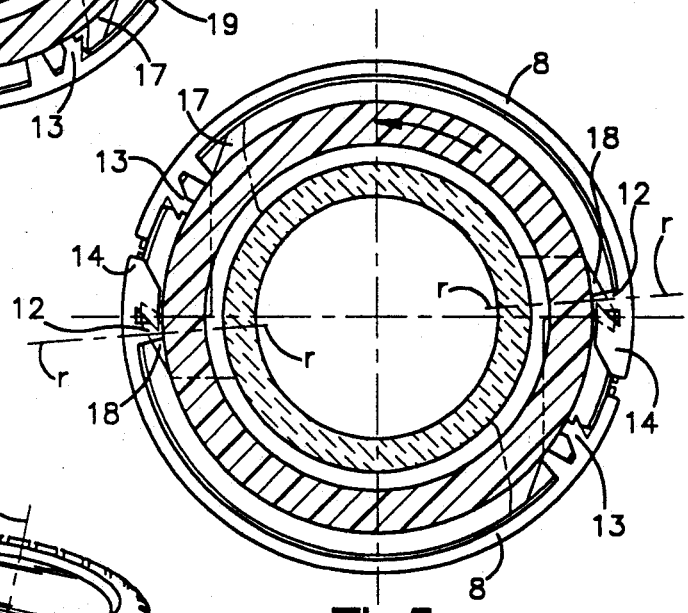
Figure 6:
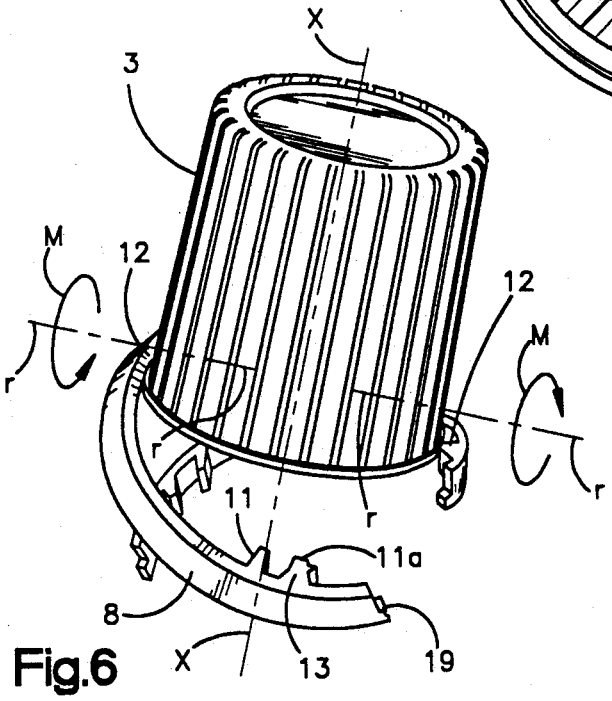

Further features and the advantages of a closure according to the invention will become apparent from the following detailed description of a preferred embodiment thereof, given by way of non-limitative example with reference to the accompanying drawing Figures, showing, FIG. 1 a sectional elevation view of a closure according to the invention, taken along line i—i;

FIG. 2 a sectional view through the closure in FIG. 1, taken along line II—II;

FIG. 3 an enlarged scale, perspective detail view of the closure in FIG. 1;

FIGS. 4 and 5 reduced scale, sectional views through the closure in FIG. 1, at successive stages of its operation; and FIG. 6 a perspective view of the closure in FIG. 1, at a further stage of its operation:

With reference to the drawing views, generally indicated at 1 is a tamper-proof closure for a bottle 2.

The closure 1 comprises a cap 3 having an axis X—X. A threadway 4 is formed internally on the cap 3, and a corresponding threadway 5 is formed externally on the bottle 2. Thus, the cap 3 can be screwed off and onto the bottle 2 whenever required, by turning it in the directions of arrows F and G, respectively.

The closure 1 also comprises a sealing band 6, formed integrally with the cap 3 coaxially therewith, such as by an injection molding process using a suitable plastics material. The sealing band 6 is substantially tubular in shape, with a predetermined height from an upper edge 6*a* to a lower edge 6*b*. The upper edge 6*a* of the sealing band 6 is connected to the cap 3 across a weakening line 7 which is obtained by providing bridge portions 11, 12, 11*a* to be described.

In this closure 1, the sealing band 6 is split into two identical arched sections, both denoted by 8 and having each an angular extension of slightly less than 180 degrees. Each of the arched sections 8 has a leading end 9 and a trailing end 10 in the screw-off direction of the cap.

The ends 9 and 10 of each arched section 8 face the ends 10 and 9 of the adjacent arched section endwise.

Two bridge portions 11 and 12 extend between each of the arched portions 8 and the cap 3. It should be noted that the leading bridge portion 11 is located proximate to the leading end 9 of the arched section, and that the trailing bridge portion 12 is located proximate to the trailing end 10 of the arched section.

The leading bridge portion 11 has a slimmer cross-section, e.g. of 0.3×0.3 mm, so as to be frangible. The trailing bridge portion 12 has a cross-section, e.g. of 0.3×0.6 mm, selected not to undergo rupture but rather a twisting action to provide a hinge 12*a* for the arched section 8 about an axis r—r perpendicular to X—X.

Formed to full height inwardly of each arched section 8 are two abutments 13 and 14 having a sawtooth-shaped profile. It should be noted that the leading abutment 13 is located proximate to the leading bridge portion 11, and that the trailing abutment 14 is located proximate to the trailing bridge portion 12, downstream of the former in the cap screw-off direction.

The abutments 13 and 14 of each arched section 8 are set apart by an angular distance A, e.g. of about 150 degrees.

Preferably, an auxiliary bridge portion 11*a* extends betwwen each leading abutment 13 and the cap 3. This has a slim cross-section, e.g. of 0.15×0.4 mm, in order to be frangible.

The bridge portions 11 and 12, and the auxiliary bridge portions 11*a*, of both arched sections 8 form together the aforesaid weakening line 7.

For each of the arched sections 8, the bottle 2 is formed with two teeth 17 and 18 having a sawtooth-shaped profile and being intended for engagement respectively by the abutments 13 and 14 of the respective arched section upon rotation of the cap in the screw-off direction as shown by arrow F.

Said teeth 17 and 18 are set angularly apart by an angular distance B, e.g. of 130 degrees.

Thus, angular distance A will exceed angular distance B by an angular length C of about 20 degrees in the example shown.

The teeth 17 and 18 have an upper edge 18*a* at a spacing from the edge 6*a* in the direction X—X.

The trailing abutment 14 is formed with a cutout 14*a* which defines a ramp 14*b* extending a predetermined distance from edge 6*b* and facing forward in the screw-off direction of the cap, so as to engage the upper edge 18*a* of tooth 18 during the screw-off operation.

It should be also noted that between the end 9 of each arched section 8 and the end 10 of the other, adjacent arched section 8, there extends a thin frangible jumper 19 which is sized to be readily ruptured together with the leading bridge portion 11 and the auxiliary leading bridge portion 11*a*.

The operation of the closure 1 according to the invention will be described herein below with reference to an initial condition, illustrated by FIGS. 1 and 3, whereby the closure 1 is installed on the bottle 2, after filling the latter, for example by axial fitting or thread engagement thereof, in the direction of arrow G. In this case, the abutments and teeth overlap each other by resilient engagement of the backs of the sawtooth profiles.

It matters to observe that in the initial condition, the abutments 13 and 14 of each of the arched sections 8 locate at a position angularly ahead of the respective teeth 17 and 18.

The closure is unsealed by screwing off the cap 3, turning it in the direction of arrow F. After a short rotational movement, for each arched section 8, the leading abutment 13 will engage with the tooth 17 in mating relationship of the sawtooth profiles (see FIG. 4).

Further rotation results in the jumpers 19, leading bridge portion 11, and auxiliary bridge portion 11*a* of each arched section being ruptured. Rupture of the jumper 19 and the bridge portions 11 and 11*a* takes place quite positively, because of these lying close to the abutment, and accordingly, the force will at once concentrate thereon as, after engaging the abutment 13 with the tooth 17, the cap rotation in the screw-off direction is maintained by application of an adequate force.

Following the aforesaid ruptures, the leading ends of each arched section will come free of the other arched section and the cap.

Continued rotation, with an angular lag C equal to the angular difference between A and B of about 20 degrees, will result in the ramp 14*b* of the trailing abutment 14 engaging the upper edge 18*a* of tooth 18 (see FIG. 5).

As the cap is rotated still further, the ramp 14*b* of abutment 14 will ride up the tooth 18, thereby the abutment 14 is moved upwards, entraining upwards therealong the trailing end 10 of the arched section. Consequently to this, the bridge portion 12 undergoes torsional deformation about the axis r—r to perform its function as a hinge for the arched section.

In other words, the engagement of the abutment 14 with the tooth 18 generates a torque, denoted by M, causing the arched section 8 to be shifted angularly about the hinge 12*a*.

Further rotation of the cap results in the arched section being displaced further angularly until the abutment rides over and past the tooth. Thus, the arched section 8 will come to lie obliquely to the axis X—X at a fully visible location (see FIG. 6).

A major advantage of the closure according to this invention resides in an improved indication of it having been unsealed.

Another advantage of the closure according to this invention is that the bottle is more convenient to use on account of the sealing band being moved positively away from the bottle.

A further advantage of the inventive closure resides in its dimensional stability, from the time it is manufactured to the time the bottle is opened, as brought about by the jumpers and auxiliary bridge portions provided co-operating with the bridge portions to hold in place the arched sections and form the band.

Understandably, the closure described in the foregoing may be variously altered and modified by a skilled person in the art for the purpose of filling specific and contingent requirements, still within the scope of this invention as defined in the appended claims.

I claim:

1. A tamper resistant closure apparatus for a container having an opening and defining teeth disposed about the opening, said closure apparatus comprising:

a) a cap sized for covering said opening when secured over said opening, and means for removably securing said cap over said opening in response to relative rotation between said cap and said opening;

b) a sealing band comprising a plurality of curved segments arranged to approximately form a tube and positioned between said container opening and said cap when said cap is secured over said opening, each curved segment defining abutments thereon disposed for engagement with said teeth;

c) wherein each of said curved segments defines a leading end and a trailing end relative to the direction of rotation required for removal of said cap from said opening;

d) a plurality of bridge sections, each bridge section connecting a portion of said sealing band to said cap;

e) wherein a bridge section and an abutment are located proximate both the leading end and the trailing end of each curved segment;

f) wherein each bridge portion which is located proximate the leading end of a curved segment has a slim cross-section to enhance frangibility of said bridge portion in response to engagement of its associated abutment located proximate said leading end with one of said teeth, and wherein each bridge portion which is located proximate a trailing end of a curved segment has a cross-section adapted to form a hinge for facilitating angular displacement of the associated curved segment in response to the engagement of an associated abutment located proximate said trailing end of said segment with one of said teeth during cap removal rotation; and, g) the abutments of each curved section being separated by angular displacement greater than angular displacement separating adjacent teeth disposed about said container opening.

2. The apparatus of claim 1, wherein a said abutment located proximate a trailing end of a curved segment defines a ramp.

3. The apparatus of claim 2, further comprising a frangible auxiliary bridge portion extending between an abutment located proximate a leading edge of a curved segment and said cap.

4. The apparatus of claim 3, further comprising a thin frangible jumper extending between adjacent ends of two curved segments, said jumper being sized to be less resistant to rupture than is the combination of a bridge portion located proximate a leading end of a curved segment and said auxiliary bridge portion.

* * * * *